United States Patent [19]

Kono et al.

[11] 4,106,760

[45] Aug. 15, 1978

[54] APPARATUS FOR REPAIRING THE FURNACE LINING WITH A SPRAY PIPE OF NON-CIRCULAR HOLLOW CROSS SECTION

[75] Inventors: Hiroshi Kono; Sueki Kubo; Tadahiko Matsuno, all of Kitayushu, Japan

[73] Assignee: Kurosaki Refractories Co., Ltd., Fukuoka, Japan

[21] Appl. No.: 750,778

[22] Filed: Dec. 15, 1976

[30] Foreign Application Priority Data

Dec. 25, 1975 [JP] Japan ..... 50-158436

[51] Int. Cl.[2] ..... B05C 7/02

[52] U.S. Cl. ..... 266/281; 118/317; 118/306

[58] Field of Search ..... 264/30; 266/281, 287; 118/306, 317, 323; 239/132.3, 165; 214/32

[56] References Cited

U.S. PATENT DOCUMENTS

| | | | |
|---|---|---|---|
| 966,986 | 8/1910 | Barnett et al. | 214/32 |
| 3,827,633 | 8/1974 | Kouno et al. | 239/132.3 |
| 3,957,203 | 5/1976 | Bullard | 118/317 |

FOREIGN PATENT DOCUMENTS

| | | | |
|---|---|---|---|
| 1,528,137 | 6/1968 | France | 266/281 |

*Primary Examiner*—Gerald A. Dost
*Attorney, Agent, or Firm*—Frank J. Jordan

[57] ABSTRACT

A gunning apparatus for repairing a furnace lining is provided with a spray pipe of non-circular hollow cross-section. The spray pipe of non-circular cross section slidably moves back and forth within a rocking sleeve by a slide mechanism while the spray pipe is non-rotatable relative to the slide mechanism and is rotatable only by the rotation of the slide mechanism, whereby the shooting pipe is manipulated without weakening the rigidity or strength thereof which usually occurs on a conventional circular shooting pipe which requires keyways for rotation thereof.

19 Claims, 25 Drawing Figures

FIG.6A
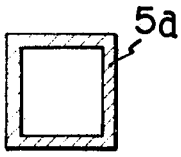
FIG. 6 B
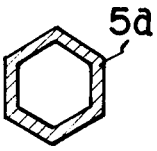
FIG.6C
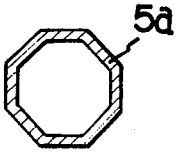
FIG.6D
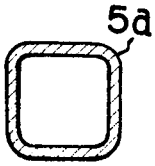
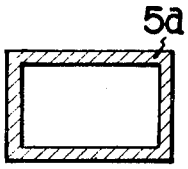
FIG.6E
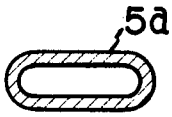
FIG.6F
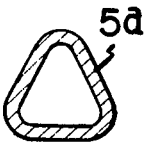
FIG.6G
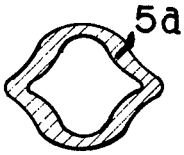
FIG.6H
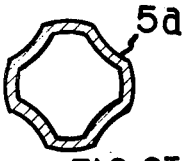
FIG.6I

APPARATUS FOR REPAIRING THE FURNACE LINING WITH A SPRAY PIPE OF NON-CIRCULAR HOLLOW CROSS SECTION

BACKGROUND OF THE INVENTION

This invention relates to an apparatus for repairing the lining of a furnace used in a steel making plant, and more particularly to a spray pipe of non-circular hollow cross-section and the mechanisms to operate the above spray pipe.

A conventional spray pipe has a cross section defined by a complete circle and is generally manipulated such that the pipe is tilted in an upward or downward direction as well as to the right or left and is slidable in an axial direction and is further rotated on the axis of the spray pipe.

Although the above described conventional spray pipe has been sufficient and effective when manually operated, such shooting pipe of circular above cross section is not proper when the revolving or sliding operations of the spray pipe must be mechanically or automatically conducted in order to meet the requirement of improved mobility or operability of the gunning device in currently sophisticated steel making plants.

Therefore the spray pipe must be provided with a guiding mechanism which works with rotating and slide mechanisms.

However, since the conventional pipe is made of a comparatively thin circular tube such as a gas pipe, a guiding mechanism cannot be formed thereon, and even if a guide could be provided by making a keyway along the pipe, the pipe would decrease drastically in rigidity or strength. On the other hand in order to maintain the rigidity or strength, the entire weight of the pipe would be increased and the cost of producing such a pipe is considerably very high.

Accordingly, it is an object of the present invention to provide a shooting pipe with a non-circular cross section which would resolve the aforementioned problems.

Moreover the conventional method for repairing the furnace lining requires at least some number of operators who are under high radiation heat conditions and since the pipe is manually operated, the operators are subject to heavy labor.

Therefore it is another object of the present invention to provide a gunning apparatus which is provided with a above spray pipe and desired mechanism which can manipulate the spray pipe automatically.

BRIEF DESCRIPTION OF THE DRAWINGS

FIG. 6A through FIG. 6I are cross sectional views of the non-circular shooting pipes applicable to the apparatus of this invention.

DETAILED DESCRIPTION OF THE INVENTION

The apparatus for repairing the furnace lining of this invention which is provided with the improved type of spray pipe is hereinafter disclosed in the following embodiments in conjunction with the attached drawings.

First Embodiment

Figure 1:
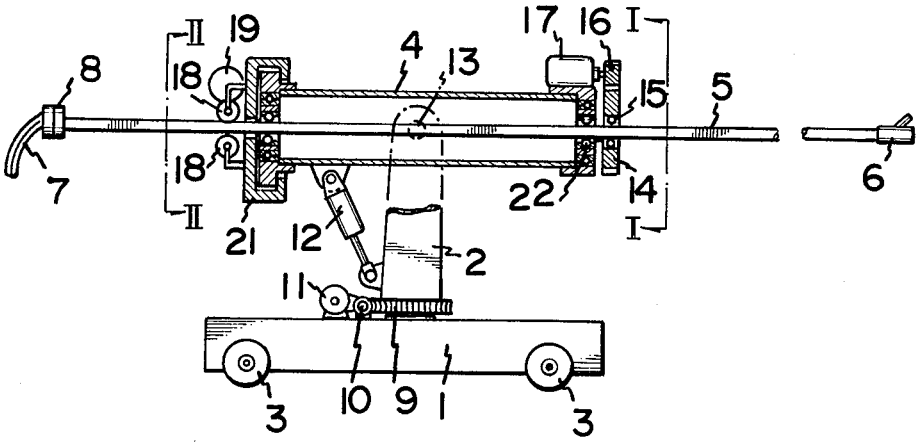
FIG. 1 is a side view with a part in cross section of the gunning apparatus of the first embodiment of this invention.
Figure 2:
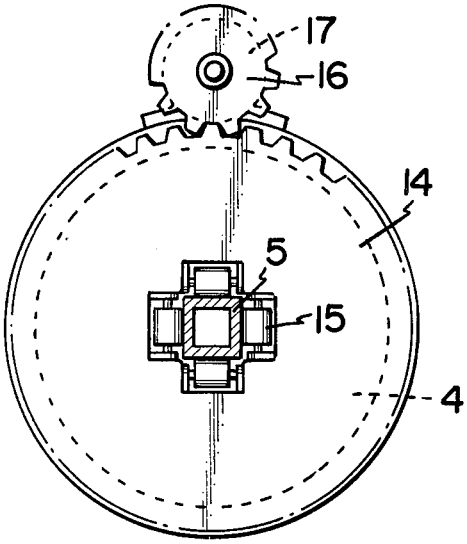
FIG. 2 is an enlarged cross sectional view of the above apparatus taken on line I—I of FIG. 1.
Figure 3:
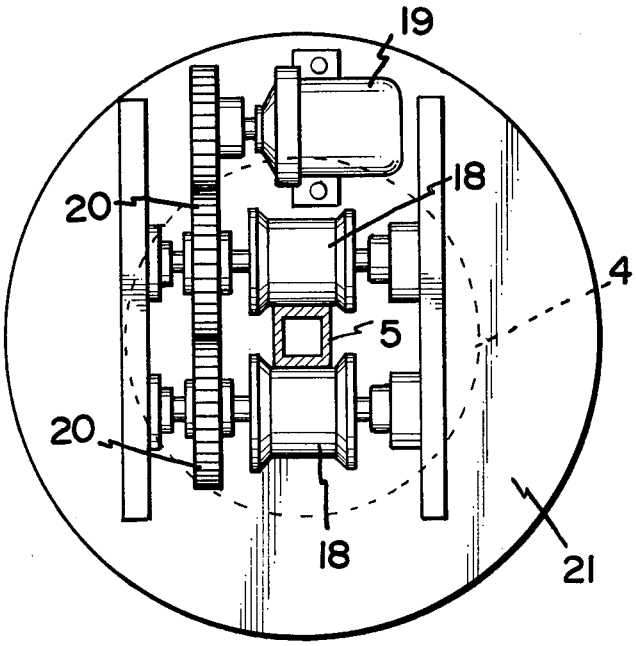
FIG. 3 is an enlarged cross sectional view of the above apparatus taken on line II—II of FIG. 1.

The gunning device of the first embodiment is shown in FIG. 1 through FIG. 3 and is generally used for the repairing of the lining of a converter furnace or an open-hearth furance.

In the drawings, a support column 2 is rotatably mounted on a transport car 1 which in turn is provided with four wheels 3 for facilitating the mobility of the transport car 1.

A rocking sleeve 4 is tiltably mounted on the top of the support column 2 and a long rigid spray pipe 5 having a non-circular hollow cross section thereof is slidably disposed in the rocking sleeve 4.

A spray nozzle 6 is fixed to the front end of the spray pipe 5 while a hose 7 is rotatably connected with the pipe 5 by means of a swivel joint 8.

The hose 7 is connected to a suitable mixer (not shown in the drawing) arranged to supply refractory material in proper form for spraying.

In this invention, the rotating means for rotating the support column 2 on the vertical axis thereof comprises a worm wheel 9 fixedly secured to the base portion of the support column 2, a worm gear 10 which meshes with the worm wheel 9 on the same level, and a drive means such as a power-operated motor for driving the worm wheel 10.

Numeral 12 indicates a tilting means such as a hydraulic cylinder for effecting a rocking movement of the rocking sleeve 4, and this hydraulic cylinder 12 is diagonally disposed on the transport car 1 while numeral 13 indicates a pivot shaft which pivotally connects the rocking sleeve 4 to the support column 2.

The rotating means for rotating the non-circular spray pipe 5 of this embodiment comprises a spur wheel 14 which receives the spray pipe 5 slidably but non-rotatably by way of slide bearing 15, a spur gear 16 which meshes with the spur wheel 14, and a drive means 17 such as a power-operated motor which is mounted on the front end of the rocking sleeve 4 for rotating the spur gear 16.

The means for causing the spray pipe 5 to move longitudinally towards or away from the furnace (not shown in the drawing) or relative to the rocking sleeve 4 is disposed at the rear end of the rocking sleeve 4 and comprises guide rollers 18 which rotate firmly on either side of the non-circular spray pipe 5 so as to move the non-circular shooting pipe 5 back and forth at opposite sides, a drive means 19 such as a power-operated motor for driving guide rollers by way of gear means 20 and a rotating circular plate 21 which is rotatably mounted on the flange portion of the rocking sleeve 4 for integrally rotating the guide rollers 18, drive means 19, and gear means 20 with shooting pipe 5 relative to the rocking sleeve 4 and which are all mounted on the circular plate 21.

At each longitudinal end of the rocking sleeve 4, duplicate bearings 22 are provided wherein the bearings allow the rotation of the non-circular spray pipe 5 relative to the rocking sleeve 4.

Second Embodiment

Figure 4:
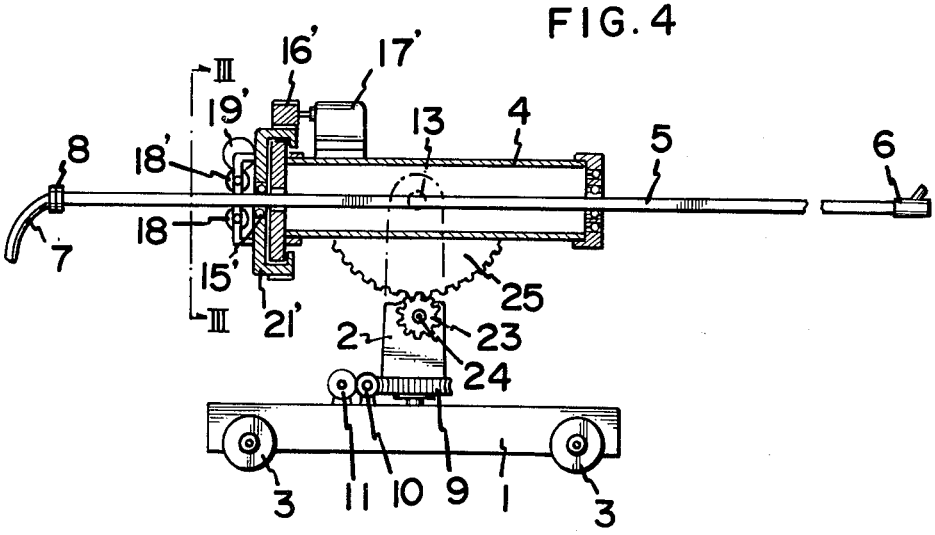
FIG. 4 is a side view with a part in cross section of the gunning apparatus of the second embodiment of this invention.
Figure 5:
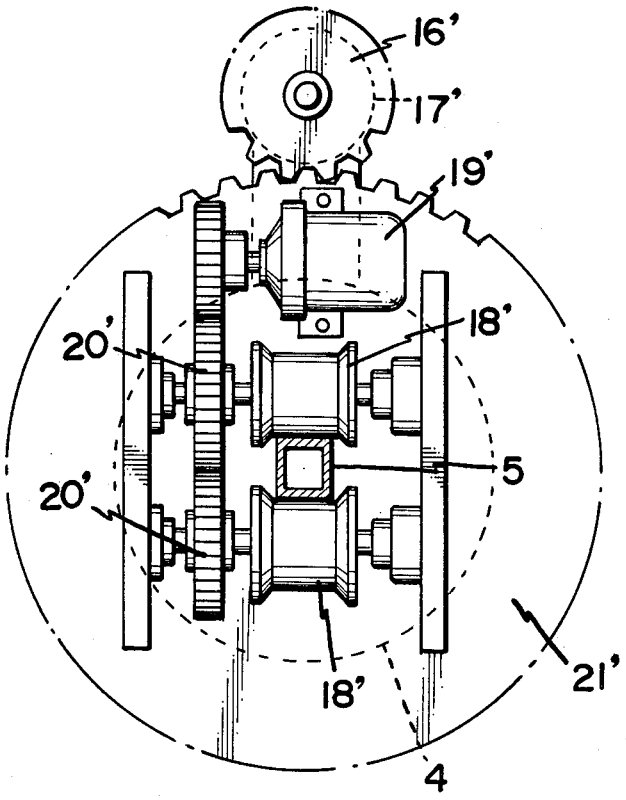
FIG. 5 is an enlarged cross sectional view of the above apparatus taken along the line III—III of FIG. 4.
Figure 7:
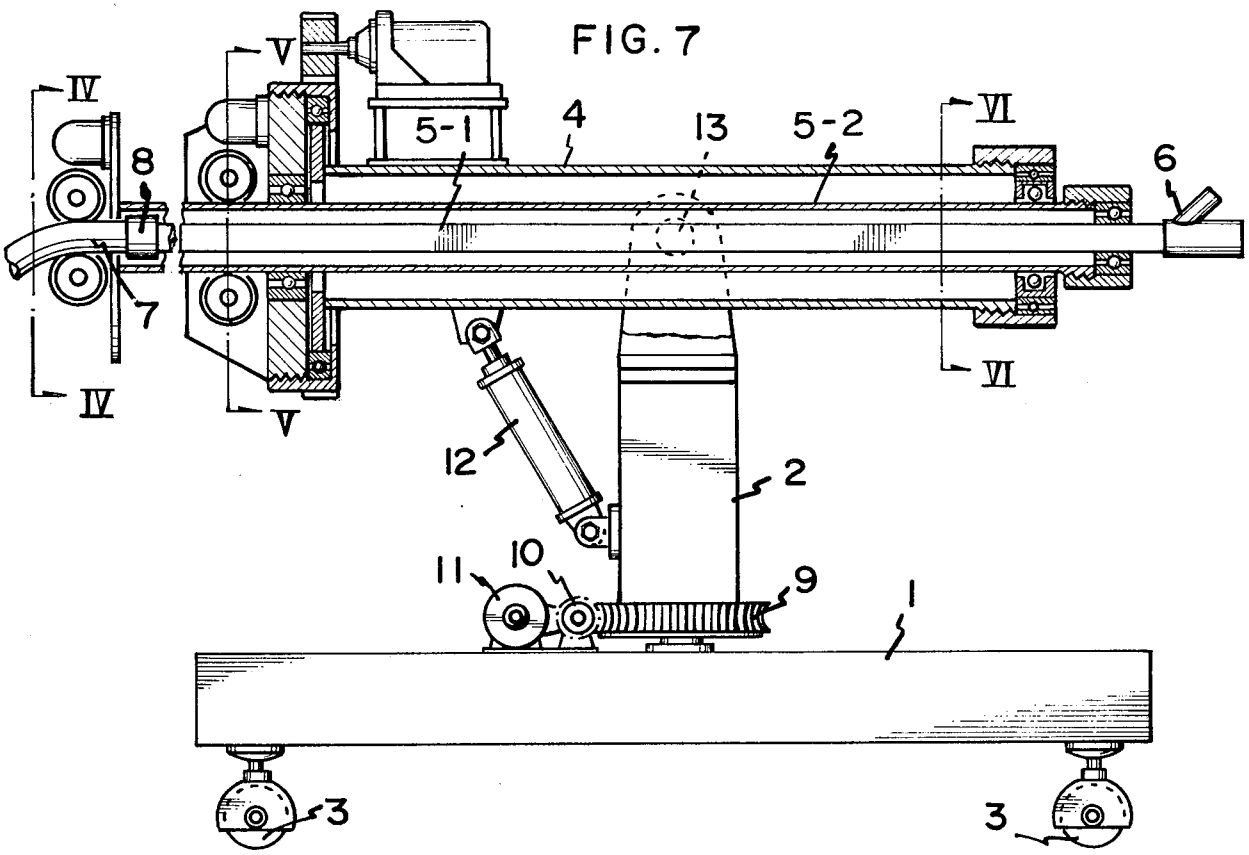
FIG. 7 is a side view with a part in cross section of the modification of the apparatus of either first or second embodiment which is provided with a non-circular shooting pipe of a duplicate-pipe construction.
Figure 8:
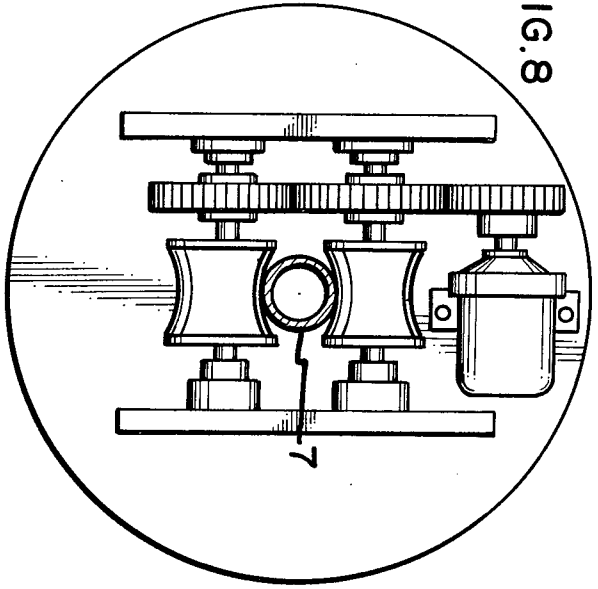
FIG. 8 is an enlarged cross-sectional view of the above apparatus taken along the line IV—IV of FIG. 7.

In FIG. 4 and FIG. 5, which is the second embodiment of the gunning apparatus there is provided with the non-circular spray pipe of this invention wherein the improvement is characterized in that the means for rotating the non-circular rotating pipe 5 relative to the rocking sleeve 4 and a means for the moving the spray pipe 5 back and forth along and within the rocking sleeve 4 are both integrally assembled at the rear end of the rocking sleeve.

The gunning apparatus of this embodiment is further provided with a gear mechanism for permitting the rocking movement of the rocking sleeve instead of the hydraulic cylinder of the first embodiment.

In the assembled construction of the rotating and slide means shown in FIG. 4, a drive means 17' for rotating the shooting pipe 5 is mounted on the rocking sleeve 4 and has a spur gear 16' fixed to the drive shaft thereof. This spur gear 16' meshes with a toothed circular plate 21' which is rotably mounted on the rear flange portion of the rocking sleeve 4. The toothed circular plate 21' is provided with a slide bearing 15' at the center thereof for facilitating the smooth lengthwise movement of the shooting pipe 5. The toothed circulr plate 21' is further provided with means for longitudinally moving the spray pipe 5 back and forth within and along the rocking sleeve 4 and which comprises guide roller means 18' and a drive means 19' for driving the guide roller means 18' by way of gear means 20'.

Referring to the means for permitting the rocking movement of the rocking sleeve 4, numeral 23 indicates a spur gear which is fixedly secured to the drive shaft 24 of a drive means (not shown in the drawing). This spur gear 23 meshes with a semi-circular spur wheel 25 secured to the lower portion of the rocking sleeve 4.

In the above embodiments, the non-circular spray pipe 5 has the cross sections disclosed in FIG. 6. These non-circular or polygonal hollow cross sections have at least one sliding guide surfaces **5*a* thereof respectively for preventing the rotation thereof on their longitudinal axis. The spray pipe 5 of this invention may be constructed by a plurality of non-circular pipes so that the spray pipe 5 can be extended or retracted in a telescopic manner whereby the lengthwise slide movement of the spray pipe 5** is further improved.

Figure 9:
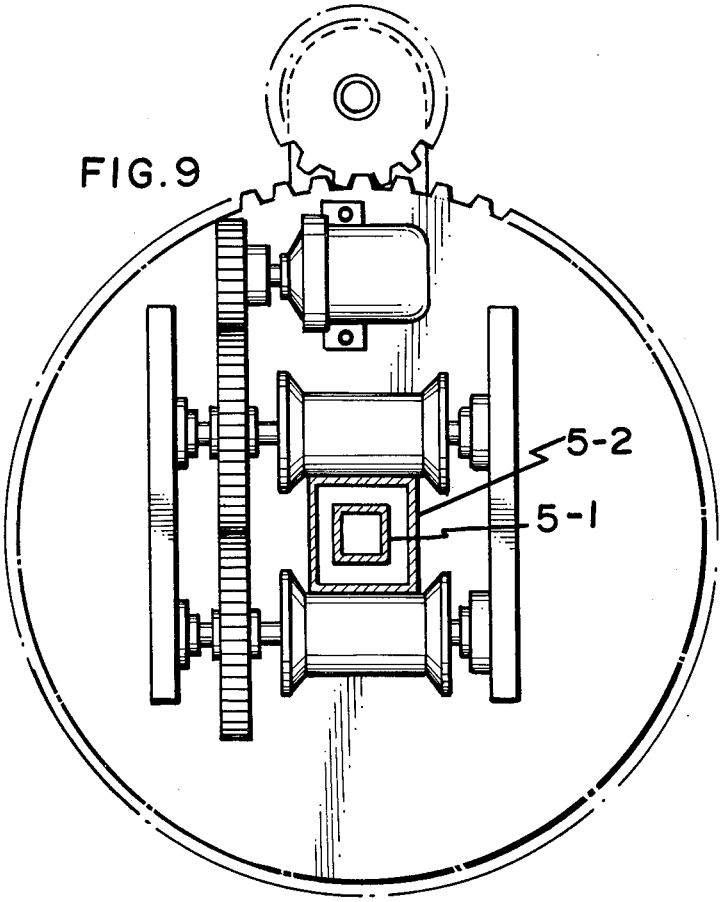
FIG. 9 is an enlarged cross-sectional view of the above apparatus taken along the line V—V of FIG. 7.
Figure 10:
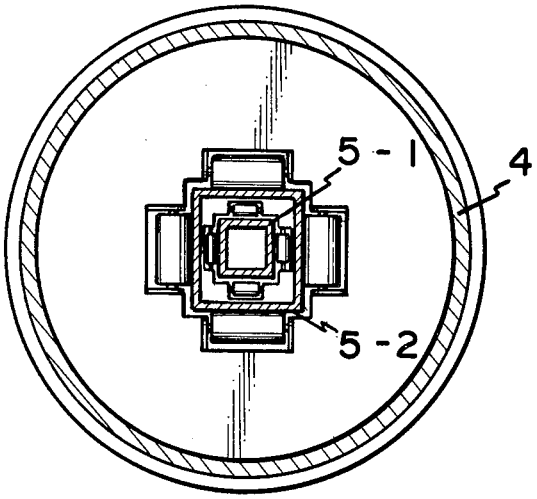
FIG. 10 is an enlarged cross-sectional view of the above apparatus taken along the line VI—VI of FIG. 7.

FIG. 9 shows such a construction of the spray pipe which is telescopically extended or retracted in two stages, wherein numeral 5-1 indicates a secondary pipe which slidably but non-rotatably encloses a primary spray pipe 5.

For the above purpose, the primary and secondary pipes 5 and 5-1 have the corresponding hollow square cross sections.

The spray pipe may be further telescopically constructed such that each inner pipe has at least one contacting point on the rotating locus thereof which contacts with the inner surface of the outer pipe so that each contacting point works as a means for preventing the rotation of the inner pipe as well as a means for guiding the reciprocation of the inner pipe.

FIG. 6A through FIG. various show varios cross sections which are suitable as a cross section of the spray pipe of this invention wherein the experiments have proven that the shooting pipes having the cross sections shown in FIG. 6A through FIG. 6D are most suitable and have following advantages;

(i) The refractory material in either wet or dry form can smoothly pass through the pipe.

(ii) The refractory material does not adhere to the inner surface of the pipe.

(iii) The pipe can maintain high rigidity thereof.

To recapitulate the operation of the apparatus of the first and second embodiments, the support column is rotatably mounted on the transport car by means of the drive means and the combination of the worm gear and worm wheel so that the shooting pipe is also rotated on the vertical axis of the support column while the hydraulic cylinder or the gear mechanism which comprises the semi-circular wheel and the drive gear is capable of rocking the rocking sleeve so that the spray nozzle fixed to the extremity of the spray pipe can be displaced vertically within the furnace. The spray pipe is also rotated on its axis within and relative to the rocking sleeve by either a combination of the drive means, gear means and circular rotating plate or a combination of drive means, gear means and circular rotating plate so that the spraying direction of the spray nozzle is displaced at an angle of 360° while the spray pipe is furthermore movable back and forth within and relative to the rocking sleeve so that the spray pipe can be displaced in a lengthwise direction within and relative to the furnace.

Therefore, the spray pipe, or more particularly the spray nozzle fixed to the front end of the spray pipe can be moved vertically and horizontally while the pipe can be also moved back and forth whereby the operation for repairing the furnace lining is conducted mechanically and automatically by a remote control means (not shown in drawings).

Third Embodiment

Figure 12:
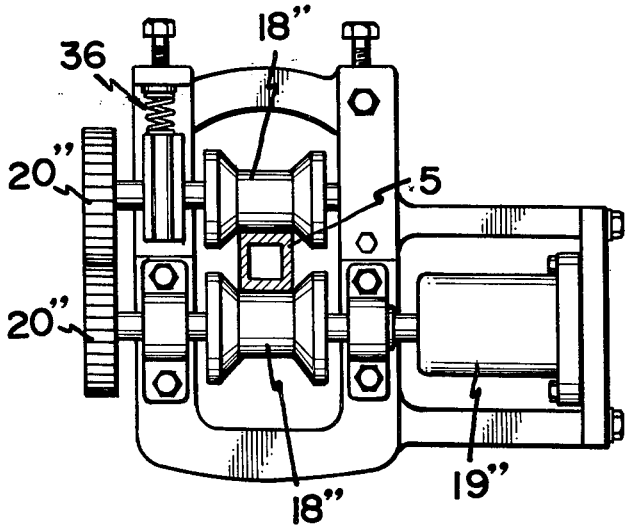
FIG. 12 is an enlarged rear end view of the above apparatus taken along the line VII—VII of FIG. 11.
Figure 13:
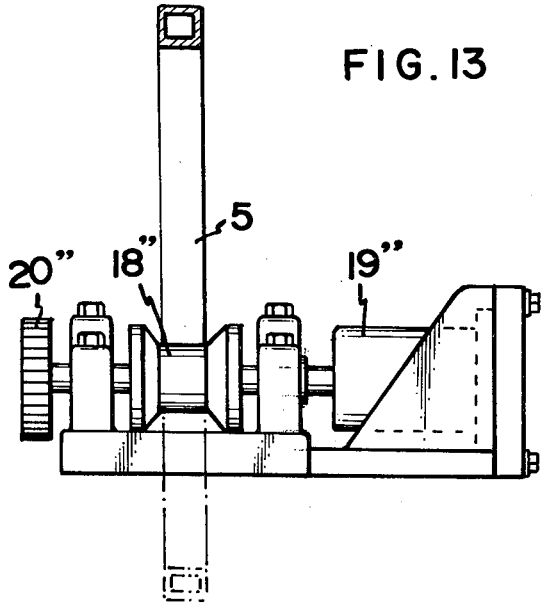
FIG. 13 is another enlarged rear end view of the above apparatus taken along the line VIII—VIII of FIG. 11.
Figure 14:
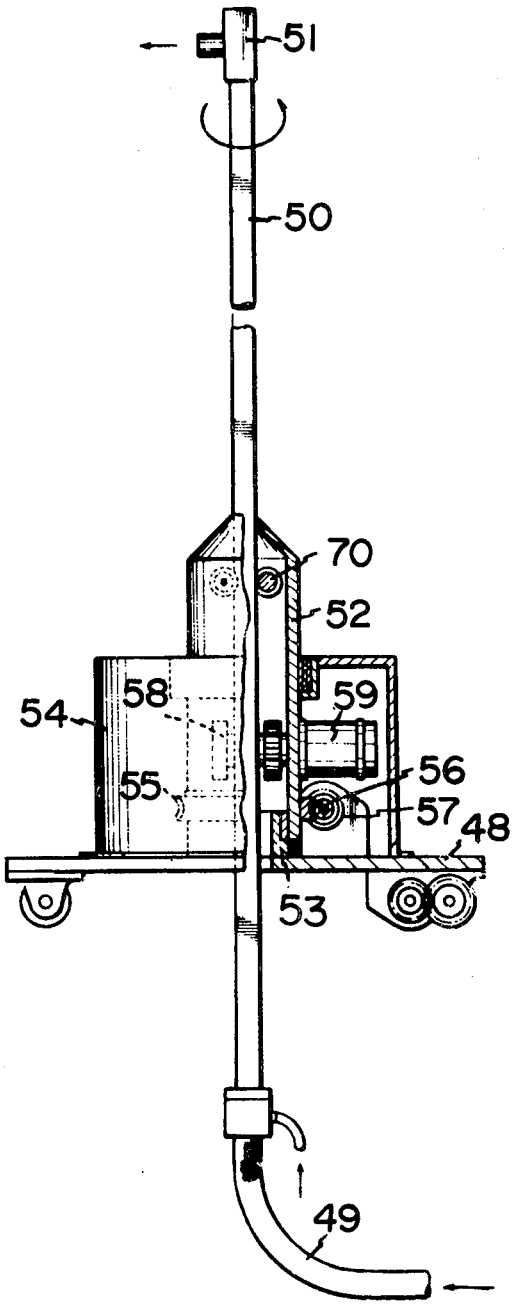
FIG. 14 is a front view with a part broken away of the apparatus of the fourth embodiment of this invention.

The third embodiment of the gunning apparatus of this invention is described hereinafter in conjunction with the attached drawings, FIG. 11 through FIG. 13 wherein the improvement is characterized in that the rocking sleeve and the shooting pipe are integrally rotated without rotating the shooting pipe relative to the rocking sleeve as disclosed in the first embodiment.

Figure 11:
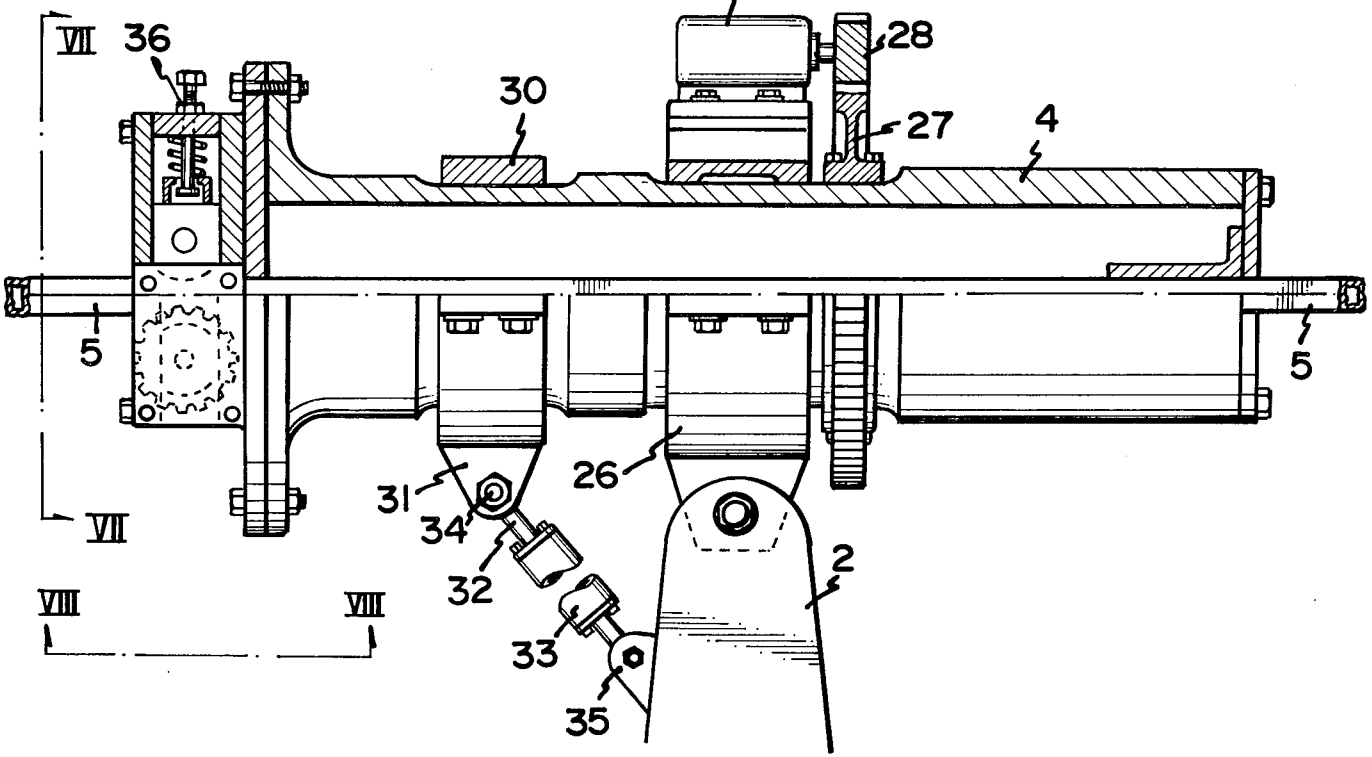
FIG. 11 is a partial side view with a portion in cross section of the apparatus of the third embodiment of this invention.

As shown in FIG. 11, the means for rotating the shooting pipe 5 is constructed such that a slide ring 26 which is pivotally mounted on the top of the support column 2 by a pivot pin rotatably receives the middle portion of the rocking sleeve 4. Adjacent to the slide ring 26, a spur wheel 27 is fixedly secured around the rocking sleeve 4. This spur wheel 27 meshes with a sur gear 28 fixed to the drive shaft of a drive means 29 such as a power-operated motor which is fixedly mounted on the top portion of the slide ring 26.

Another slide ring 30 is rotatably mounted on the rocking sleeve 4 in place and has a lug 31 formed at the lower portion thereof. An actuating rod 32 of a diagonally disposed hydraulic cylinder 33 is pivotally connected by a pin 34 to the above lug 31 while the distal end of the cylinder 33 ia pivotally secured to a lug 35 formed to the side of support column 2.

Referring to the means for moving the spray pipe 5 back and forth relative to the rocking sleeve 4, the construction of the means of the third embodiment corresponds with the construction of previous embodiments with the exception of spring means 36 which biasingly urge the guide rollers 18" so that the rollers 18" can move the spray pipe 5 without causing the slip between surface of rollers 18" and the flat longitudinal surface of the spray pipe 5.

According to the gunning apparatus of this invention, since the spray nozzle of the spray pipe can be easily manipulated vertically and horizontally as well as in a lengthwise direction whereby the operation for repairing the furnace lining is mechanically conducted at the place of operation remote from the vicinity of furnace which is subject to the high-temperature radiation from the furnace.

Fourth Embodiment

Figure 15:
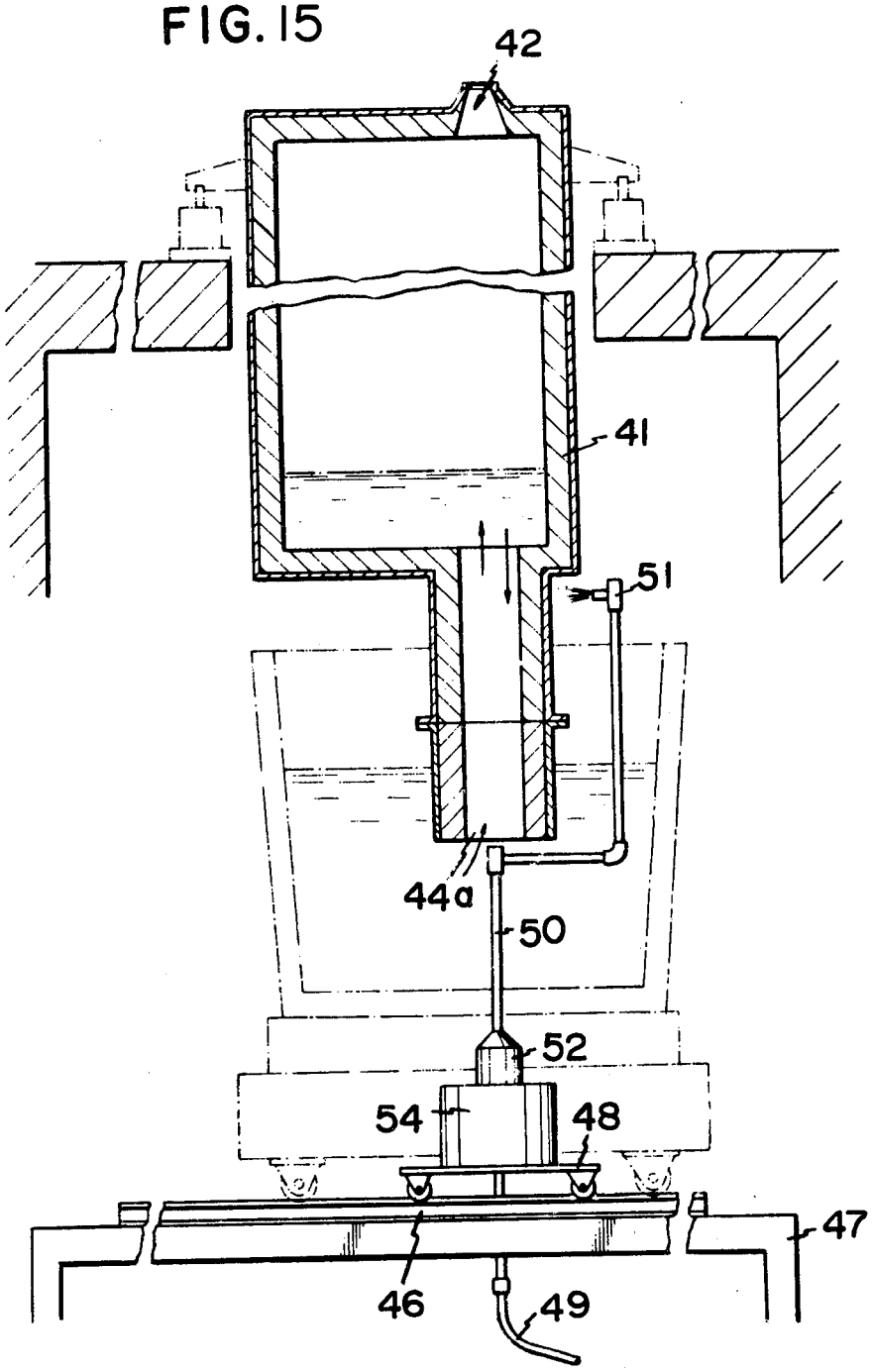
FIG. 15 is a front view of the above apparatus repairing a DH furnace.
Figure 16:
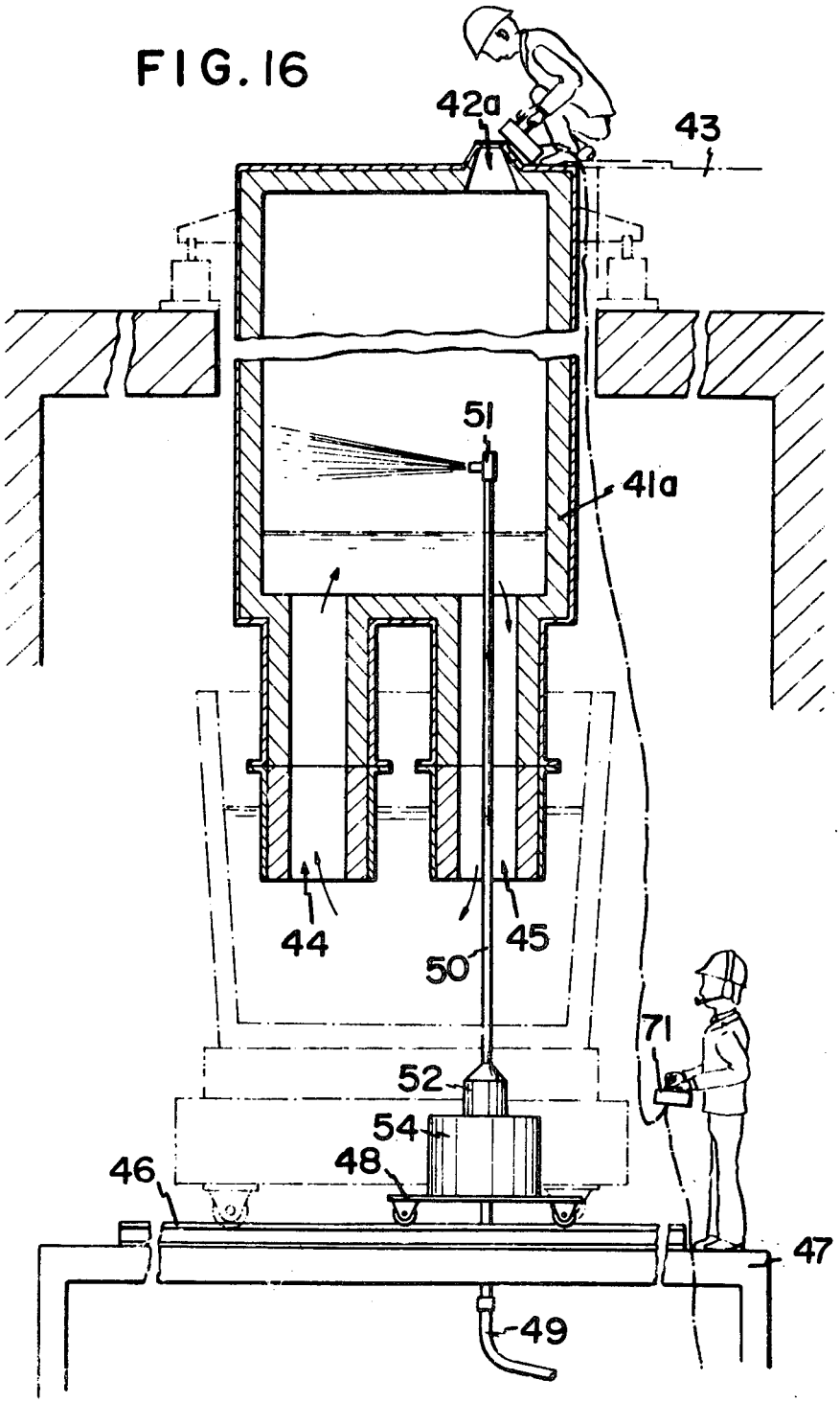
FIG. 16 is a front view of the above apparatus repairing a RH furnace.
Figure 17:
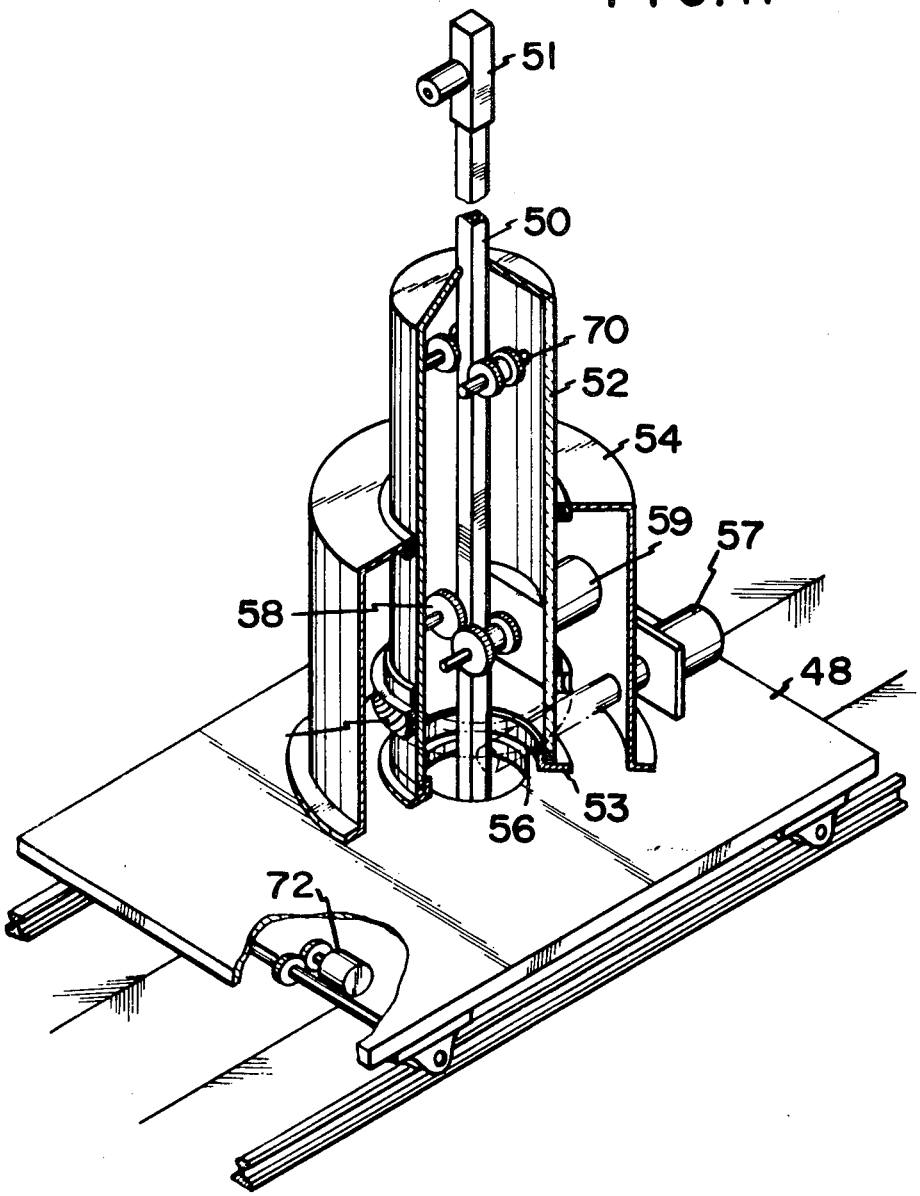
FIG. 17 is a perspective view of the above apparatus in operation.

The fourth embodiment relates to a gunning apparatus which is characterized in that the gunning apparatus is constructed such that it can repair the lining of a reactor furnace such as a DH furnace (FIG. 15) and a RH furnace (FIG. 16)

A typical structure of the apparatus of this embodiment is described in great detail in conjunction with the attached drawings.

Referring to FIGS. 14 to 17, numeral 41(FIG. 15) indicates a DH furnace, numeral 41a (FIG. 16) indicates an RH furnace, numerals 42 and 42a indicate observation windows through which a viewer can observe the spraying operation within the furnace 41 and 41a and which is disposed on an upper working deck such as the working deck 43 over the furnace 41a. Numerals 44 and 45 in FIG. 16 respectively indicate a suction pipe and a discharge pipe of the furnace 41*a*. Numeral 44*a* in FIG. 15 indicates a suction pipe.

With respect to the apparatus which has been devised to enable the optimum degree of repair operations to the furnace, numeral 46 indicates rails laid on a lower working deck 47, numeral 48 indicates a transport car which is movable on the rails 46 and which carries the spraying device thereon, and numeral 49 indicates a hose for supplying refractory material in a wet slurry form through a spray pipe 50 of non-circular cross section to a spary nozzle 51 which is attached to the top of the spray pipe 50. The mechanism for rotating the non-circular spray pipe 50 comprises an inner hollow cylindrical body 52 which permits elevation but which restricts rotation of the spray pipe 50 relative to the cylindrical body 52, a circular bearing means 53 mounted on the transport car 48 and which rotatably supports the inner cylindrical body 52, an outer cylindrical support frame 54 mounted on the car 48 and which also rotatably supports the inner cylindrical body 52, a worm gear 55 fixedly secured to the lower portion of the inner cylindrical body 52, and a worm gear 56 which is rotated by a power-operated motor 57 and which engages and drives the worm gear 55.

The mechanism to elevate the non-circular spray pipe 50 comprises elevating rollers 58 which contact and press against the spray pipe 50 from both sides, a power operated motor 59 mounted on the cylindrical body 52 and which effects rotation of the two rollers 58, and supporting rollers 70 mounted on the cylindrical body 52, which rotatably support spray pipe 50.

Numeral 71 (FIG. 16) indicates a remote control means which is usually manipulated by an operator who stands on the lower working deck, and numeral 72 (FIG. 17) indicates a power operated means to move the transport car 48 along the rails 46.

What we claim is:

1. In a apparatus for repairing the lining of a furnace with a refractory material comprising a hollow spray pipe having a uniform thickness and being defined by integral inner and outer pipe walls, said inner wall defining an unobstructed internal passageway, said refractory material contacting said inner pipe wall in passing exclusively and directly through said passageway, a rocking sleeve in which said shooting pipe is slidably disposed, a support column pivotally mounting said rocking sleeve, a sliding mechanism directly engaging said outer wall of said spray pipe for sliding said spray pipe relative to said rocking sleeve, and a rotating mechanism for rotating said sliding means about the axis of said spray pipe, said outer wall and said inner wall of said spray pipe having non-circular cross sections such that engagement of said spray pipe by said sliding mechanism precludes rotation of said shooting pipe relative to said sliding mechanism so that rotation of said sliding mechanism also rotates said spray pipe, whereby said spray pipe is manipulated without weakening the rigidity or strength thereof.

2. An apparatus according to claim 1, wherein said spray pipe has a polygonal hollow cross section.

3. An apparatus according to claim 1, wherein said spray pipe has an oblong hollow cross section.

4. An apparatus according to claim 1, wherein said spray pipe has a lip-shaped hollow cross section.

5. An apparatus according to claim 1, wherein said spray pipe has a rectangular hollow cross section.

6. An apparatus according to claim 1, wherein said support column is rotatably mounted on a movable transport car.

7. An apparatus according to claim 1, wherein said apparatus is further provided with a rocking means for rocking said rocking sleeve.

8. An apparatus according to claim 7 wherein said rocking means comprises a diagonally-disposed hydraulic cylinder which has one end pivotally connected to said rocking sleeve and another end pivotally connected the side of said support column.

9. An apparatus according to claim 7 wherein said rocking means comprises a semi-circular wheel secured to the lower peripheral side of said rocking sleeve and a power-driven wheel mounted on said support column and meshed with said semi-circular wheel.

10. An apparatus according to claim 1 wherein said spray pipe of non-circular cross section comprises a plurality of non-circular shooting pipes which can be extended or retracted in a telescopic manner.

11. An apparatus according to claim 1 wherein said sliding mechanism comprises a rotary plate rotatably mounted at the end of said rocking sleeve, a pair of roller means non-rotatably but slidably engaging said spray pipe therebetween and a means for driving said roller means.

12. An apparatus according to claim 1 wherein said rotating mechanism comprises a wheel gear slidably but non-rotatably disposing said spray pipe therein and concentrically by way of slide bearings, a pinion gear meshed with said wheel gear, and a drive means for driving said pinion gear.

13. An apparatus according to claim 1 wherein said rotating mechanism comprises an annular trunnion pivotally mounted on the top of said support column, said rocking sleeve having the central portion thereof rotatably but non-slidably disposed within said annular trunnion, a wheel gear fixedly secured to said rocking sleeve adjacent to said annular trunnion, a pinion gear meshed with said wheel gear and drive means for driving said pinion gear.

14. In an apparatus for repairing the lining of a furnaces, especially a DH furnace and a RH furnace, comprising a support column, a vertically disposed hollow spray pipe having a uniform thickness and being defined by integral inner and outer pipe walls, said inner wall defining an unobstructed internal passageway, said refractory material contacting said inner pipe wall in passing exclusively and directly through said passageway, a support body in which said spray pipe is slidably disposed, said support body being rotatably mounted on said support column, a sliding mechanism mounted on said support body and directly engaging said outer wall of said spray pipe for sliding said spray pipe relative to said support body, and a rotating mechanism for rotating said support body and said sliding mechanism about the axis of said spray pipe, said outer wall and inner wall of said spray pipe havng non-circular cross sections such that engagement of said spray pipe by said sliding mechanism precludes rotation of said spray pipe relative to said sliding mechanism and said support body so that rotation of said support body also rotates said spray pipe, whereby said spray pipe is manipulated without weakening the rigidity or strength thereof.

15. An apparatus according to claim 14 wherein said spray pipe has a polygonal hollow cross section.

16. An apparatus according to claim 14 wherein said spray pipe has an oblong hollow cross section.

17. An apparatus according to claim 14 wherein said spray pipe has a lip-shaped hollow cross section.

18. An apparatus according to claim 14 wherein said spray pipe has a rectangular hollow cross section.

19. An apparatus according to claim 14 wherein said support column is rotatably mounted on a movable transport car.

* * * * *